US008069807B2

(12) United States Patent
Kloster et al.

(10) Patent No.: US 8,069,807 B2
(45) Date of Patent: Dec. 6, 2011

(54) FLOATING DRIVE-ON WATERCRAFT DOCKING SYSTEM

(75) Inventors: Bryce Morgan Kloster, Snoqualmie, WA (US); Kenneth E. Hey, Mercer Island, WA (US)

(73) Assignee: Sunstream Corporation, Kent, WA (US)

( * ) Notice: Subject to any disclaimer, the term of this patent is extended or adjusted under 35 U.S.C. 154(b) by 312 days.

(21) Appl. No.: 12/360,062

(22) Filed: Jan. 26, 2009

(65) Prior Publication Data

US 2009/0194014 A1 Aug. 6, 2009

Related U.S. Application Data

(60) Provisional application No. 61/023,335, filed on Jan. 24, 2008.

(51) Int. Cl.
*B63B 35/44* (2006.01)

(52) U.S. Cl. ..... 114/263; 114/259

(58) Field of Classification Search ..... 114/263, 114/259

See application file for complete search history.

(56) References Cited

U.S. PATENT DOCUMENTS

| | | | | |
|---|---|---|---|---|
| 3,734,046 | A * | 5/1973 | Schmidt et al. | 114/259 |
| 3,824,644 | A | 7/1974 | Stranzinger | |
| 4,604,962 | A | 8/1986 | Guibault | |
| 4,773,346 | A | 9/1988 | Blanding et al. | |
| 5,281,055 | A | 1/1994 | Neitzke et al. | |
| 5,529,013 | A | 6/1996 | Eva, III et al. | |
| 5,641,242 | A * | 6/1997 | Riviere | 405/3 |
| 5,682,833 | A | 11/1997 | Eva, III et al. | |
| D398,576 | S | 9/1998 | Hillman et al. | |
| 5,855,180 | A | 1/1999 | Masters | |
| 5,931,113 | A | 8/1999 | Eva, III et al. | |
| 5,941,660 | A | 8/1999 | Rueckert | |
| 5,947,050 | A | 9/1999 | Eva, III et al. | |
| 6,006,687 | A | 12/1999 | Hillman et al. | |
| 6,431,106 | B1 | 8/2002 | Eva, III et al. | |
| 6,526,902 | B1 | 3/2003 | Faber | |
| 6,592,291 | B2 | 7/2003 | Foxwell | |
| 6,602,022 | B1 | 8/2003 | Wilkins | |
| 6,745,714 | B1 | 6/2004 | Faber | |
| 7,069,872 | B2 | 7/2006 | Ostreng et al. | |
| 7,293,522 | B1 | 11/2007 | Elson | |
| 2007/0169678 | A1 * | 7/2007 | Dickman | 114/263 |

* cited by examiner

*Primary Examiner* — Stephen Avila
(74) *Attorney, Agent, or Firm* — Davis Wright Tremaine LLP; George C. Rondeau, Jr.

(57) ABSTRACT

The floating drive-on docking system for a watercraft uses a main floatation portion where the watercraft rests when loaded and a pivoting entry portion for creating a low loading angle between the watercraft and the floating drive-on docking system, resulting in only a small amount of propulsion from the watercraft being required to load onto the docking system. The pivoting entry portion has entry features, either rollers or raised bumps, that remain above the waterline when not engaged by the watercraft to keep the loading surfaces free from marine growth that can harm the hull of a watercraft. Wide side guides on the pivoting entry portion assist in positioning the craft for loading onto the docking system.

31 Claims, 7 Drawing Sheets

FLOATING DRIVE-ON WATERCRAFT DOCKING SYSTEM

BACKGROUND OF INVENTION

This invention generally relates to a floating drive on docking system for a watercraft and more particularly to a drive-on docking system for a personal watercraft (PWC) with a pivoting entry to allow for easy loading and unloading.

The use of floating drive-on watercraft lifting devices is well known. A number of floating lift designs are currently known that provide this basic function. Most floating drive-on watercraft lifts are made from rotationally molded plastic and are either filled with air or foam for floatation. These lifting devices commonly have a ramped portion for loading and unloading the watercraft, a cradled docked portion for storing the watercraft and some sort of roller system or raised plastic ridges to help in transporting the watercraft from the ramped portion to the cradled portion and visa versa. A common trait among the current floating drive on watercraft lifting devices is a high loading angle between the watercraft and the lifting device. The abrupt ramped portion of the docking device forces the bow of the entering watercraft up creating the large loading angle between the watercraft and the floating lift requiring a large amount of propulsion from the watercraft to load. For an unskilled watercraft user loading can be very difficult and possibly dangerous. With too much propulsion the watercraft can easily slide over the lift and crash into any items in front of the drive-on lift. Examples of this type of floating drive-on watercraft lifting device are the Hydrohoist Hydroport (U.S. Pat. No. 7,293,522 to Elson), U.S. Pat. No. 6,431,106 to Eva, III et al., and the Jet T by Carolina Water Works, Inc.

Several devices use keel entry rollers to ease in loading the watercraft onto the dock including U.S. Pat. No. 6,006,687 to Hillman, U.S. Pat. No. 7,069,872 to Ostreng et al., and the EZPort from EZ Dock. The keel rollers help with reducing the propulsion required for loading, but marine growth can be a problem with keel rollers. If the keel roller sits in the water, marine growth, such as barnacles, muscles, oysters, etc., builds up on the roller and can damage the hull of a watercraft. Some companies choose to position the keel roller above the waterline to prevent marine growth, but this causes more problematic loading issues. With the keel roller above the waterline, the bow eye of a watercraft can catch on the keel roller while loading causing a significant jolt to the driver of the watercraft, and the loading angle is increased requiring more propulsion to load the watercraft leading to the same loading issues as the Hydrohoist Hydroport and like lifting devices.

The Tilting Dry Dock of U.S. Pat. No. 5,855,180 to Masters tries to address the loading issues of the above devices with a floating dock that seesaws to change the loading angle and reduce the propulsion required to load a watercraft. While the seesaw concept allows for reduced propulsion to load the watercraft, it does not address the growth issues that can damage the hull of a watercraft. Without a watercraft on the seesaw dry dock, the entry of the dry dock sits in the water where growth can build up. Furthermore, with the seesaw design a watercraft can be errantly launched if a person or animal walked to the back of the seesaw.

Another common problem among the current state of the art floating drive-on watercraft lifts is that most of them have a square or flat entry which requires the watercraft to be aligned properly with the entry for the watercraft to be properly loaded. If the watercraft is loaded at an angle the watercraft will slide off the side of the lift and back into the water, again, causing loading problems for the unskilled watercraft user as most PWCs do not steer very well at low speed.

Accordingly, the present invention is designed to allow for safe and effortless loading and launching of the watercraft on a floating drive-on watercraft lift.

SUMMARY OF THE INVENTION

The disclosed embodiments of the present invention are floating drive-on docking systems for a watercraft that allows for safe and effortless loading and launching of the watercraft, despite the skill level of the watercraft user. The floating drive-on docking system uses a main floatation portion where the watercraft rests when loaded and a pivoting entry portion for creating a low loading angle between the watercraft and the floating drive-on docking system, resulting in only a small amount of propulsion from the watercraft needed to load onto the docking system.

The pivoting entry portion has entry features, either rollers or raised bumps, that remain above the waterline when not engaged by the watercraft thereby keeping the loading surfaces free from marine growth that can harm the hull of a watercraft being loaded. When a watercraft engages the entry features of the pivoting entry portion, the pivoting entry portion pivots downward. The entry features further engage the watercraft hull below the waterline. The pivoting entry portion pivots downward until a downward stopping device of the pivoting entry portion engages the main floatation portion of the docking system, thus creating the desirable low loading angle between the watercraft and the docking system. In the disclosed embodiments the pivoting entry portion is buoyant to keep the entry features above the waterline when not engaged by the watercraft.

Once the watercraft is gently propelled through the pivoting entry portion, rollers guide the watercraft to the loaded position on the main floatation portion. The bow of the watercraft comes to rest on a bow stop. The portion of the bow stop that comes in contact with the bow of the watercraft is replaceable because of normal wear and tear. Once the watercraft is in the loaded position the pivoting entry portion pivots upwards and the entry feature return above the waterline. In addition to creating ease of watercraft loading, the pivoting entry portion provides extra buoyancy to the stern of the docking system when an upward stopping device of the pivoting entry portion engages the main floatation portion of the docking system.

The pivoting entry portion is shaped somewhat like a "U" to serve as a watercraft loading guide. The "U" shape is wider than half the maximum chine beam of a watercraft suitable for the docking system. The "U" shaped guide aids in loading the watercraft onto the docking system at loading directions between 0° and 90° (0° being aligned with the docking system) whereas the prior art described above requires watercraft to be substantially aligned between 0° and 10° with the docking systems to be loaded properly.

DETAILED DESCRIPTION

This following descriptions illustrate aspects of the invention, and identify preferred embodiments of these aspects. The descriptions are not intended to be exhaustive, but rather to inform and teach the person of skill in the art who will come to appreciate more fully other aspects, equivalents, and possibilities presented by invention, and hence the scope of the invention is set forth in the claims, which alone limit its scope.

Several details of the preferred embodiments are set forth in the following description: FIGS. 1 through 14 provide a thorough understanding of such embodiments. One skilled in the art will understand that the present invention may be practiced without several of the details described herein. In the following description of the embodiments, it is understood that a watercraft includes any vehicle that is at least partially waterborne, which includes boats and similar vessels, but may also include amphibious vehicles including various amphibious automobiles or aircraft. Moreover, in the description that follows, it is understood that the figures related to the disclosed embodiments are not to be interpreted as conveying any specific or relative physical dimension, and that specific or relative dimensions related to the embodiments, if stated, are not be considered limiting unless the claims state otherwise.

Figure 1:
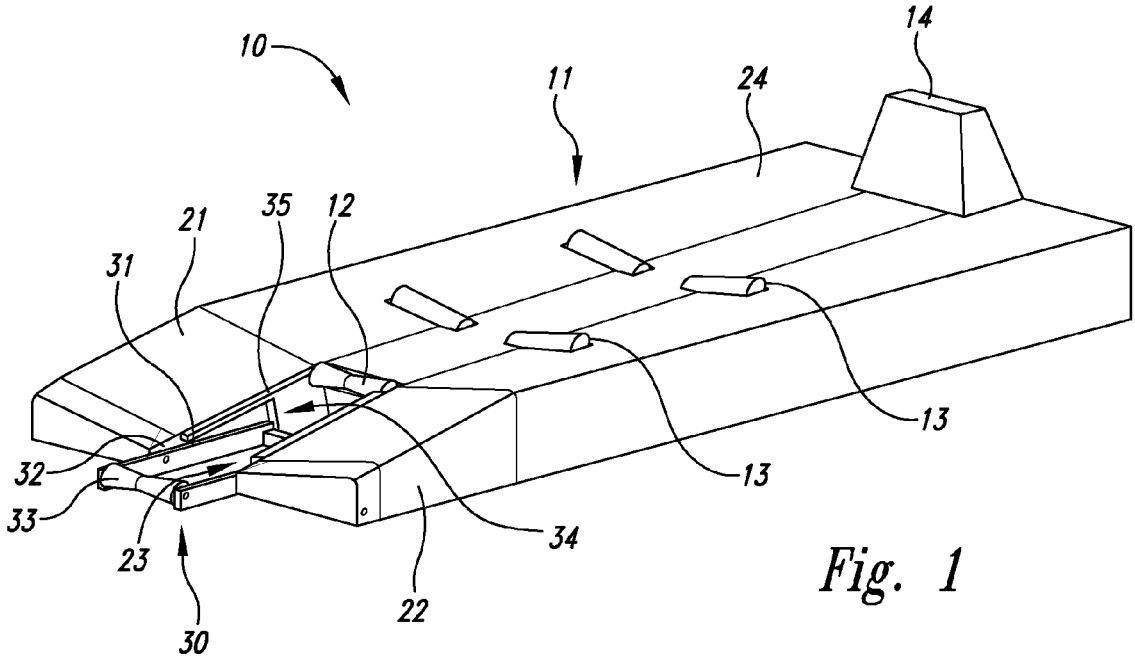
FIG. 1 is an isometric view of a floating drive-on watercraft lift.

FIG. 1 is an isometric view of a drive-on watercraft lift 10 for receiving a watercraft 51 (see FIGS. 5 and 6) driven onto the lift under its own propulsion. The drive-on watercraft lift 10 includes a floating structure 11 having an aft port extension 21, an aft starboard extension 22, and an aft opening 23 therebetween. The floating structure 11 further includes a front 24 having a bow stop 14, a rear pivoting entry portion 30, a keel roller 12 located forward of the pivoting entry portion, and hull rollers 13 located along a mid-portion of the floating structure between the bow stop and the keel roller. The bow stop 14 is configured to contact the watercraft 51 (see FIG. 5) at a location above the waterline for engaging and limiting forward movement of the watercraft loaded onto the drive-on watercraft lift 10.

Figure 2:
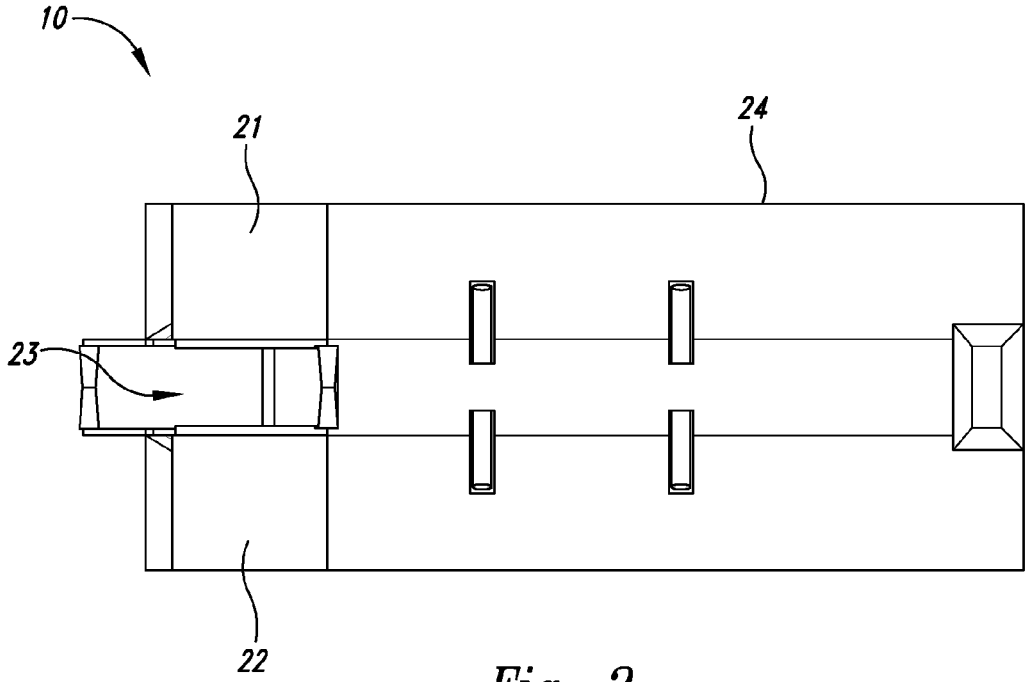
FIG. 2 is a top plan view of the floating drive-on the watercraft lift of FIG. 1.

FIG. 2 is a top plan view of the drive-on watercraft lift 10 showing aft port extension 21, aft starboard extension 22, aft opening 23, and front 24. The combined volume of aft port extension 21 and aft starboard extension 22 is substantially less than the volume of front 24 because of the presence of aft opening 23. The purpose of aft port extension 21, aft starboard extension 22, and aft opening 23 will be described below with respect to FIG. 6.

Figure 3:
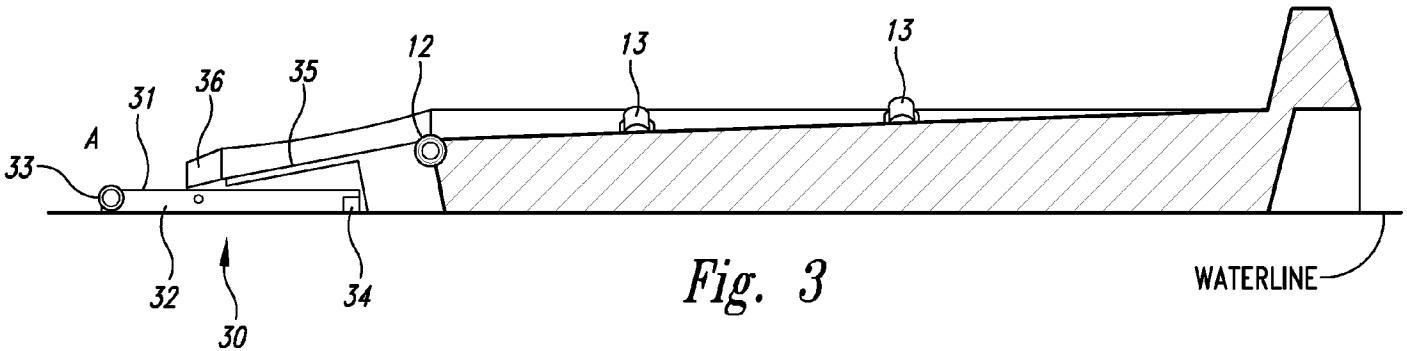
FIG. 3 is a cross-sectional side view of the floating drive-on watercraft lift of FIG. 1 with the pivoting entry portion above the waterline in a stored position.

FIG. 3 is a cross-sectional side view of drive-on watercraft lift 10 showing more detail on pivoting entry portion 30. Pivoting entry portion 30 comprise a roller assembly having a keel roller 33 attached to and positioned between rearward end portions of left and right side pivot extensions 31. The pivot extensions 31 are each pivotally mounted on a pivot 32, with the left side pivot extension being pivotally attached to the aft port extension 21 and the right side pivot extension being pivotally attached to the aft starboard extension 22. A counterbalance 34 is attached to and positioned between a forward end of left and right side pivot extensions 31. When keel roller 33 is not in contact with the hull of a watercraft (not shown), counterbalance 34 keeps pivoting entry portion 30 in the illustrated stored position "A" shown in FIG. 3 with keel roller 33 above the waterline and free from marine growth while left and right side pivot stops 36 keeps pivot extensions 31 in a substantially horizontal position.

Figure 3A:
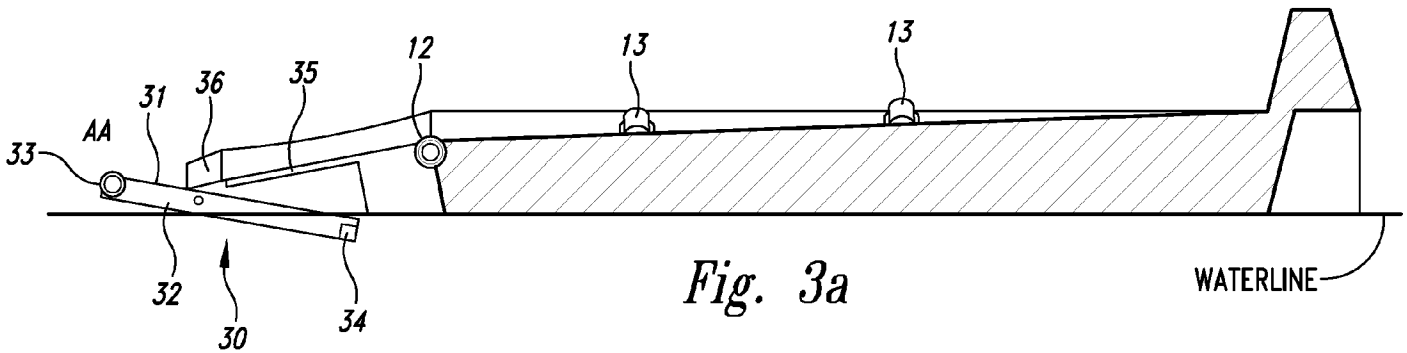
FIG. 3*a* is a cross-sectional side view of the floating drive-on watercraft lift of FIG. 1 with the pivoting entry portion above the waterline in a resting position.

FIG. 3*a* is a cross-sectional side view of the drive-on watercraft lift 10 showing pivoting entry portion 30 in the illustrated resting position "AA" with keel roller 33 substantially out of the water to prevent marine growth on keel roller 33.

Figure 4:
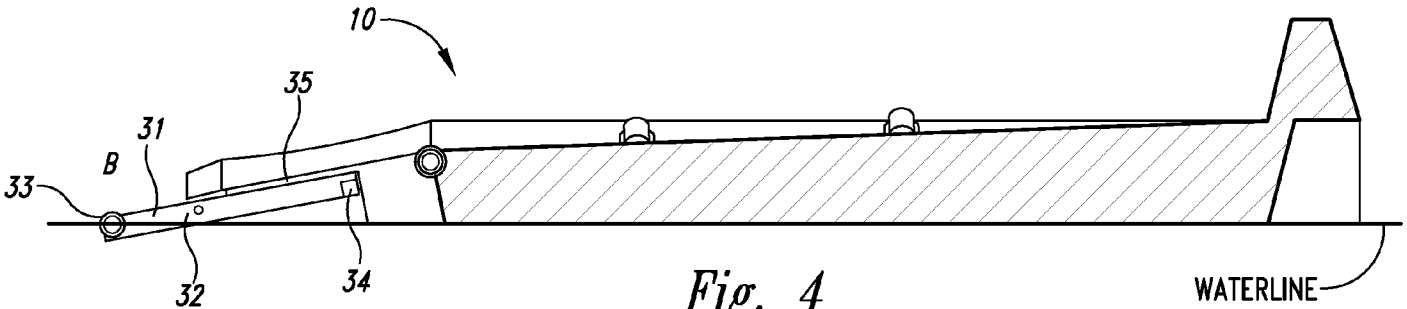
FIG. 4 is a cross-sectional side view of the floating drive-on watercraft lift of FIG. 1 with the pivoting entry portion below the waterline.

FIG. 4 is a cross-sectional side view of drive-on watercraft lift 10 with pivoting entry portion 30 in the illustrated load position "B". As the bow of a watercraft (not shown) approaches the drive-on watercraft lift 10 the bow will contact keel roller 33 causing pivot extension 31 of pivoting entry portion 30 to rotate downward on pivots 32. This causes the forward end portions of left and right side pivot extensions 31 to rotate upward until they contact left and right side pivot stops 35, thereby allowing keel roller 33 to support the load of the loading watercraft. With this arrangement, the watercraft will continues to move up and onto the drive-on watercraft lift 10 in a smooth and safe manner.

Figure 5:
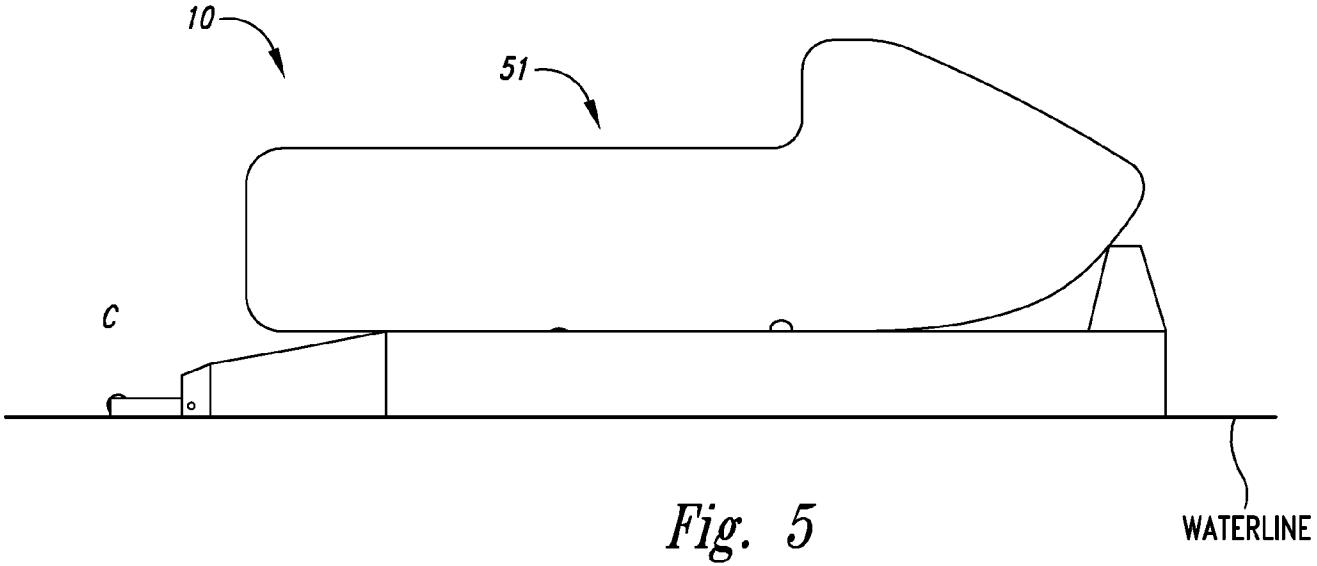
FIG. 5 is side view of the floating drive-on watercraft lift of FIG. 1 loaded with a watercraft in the loaded position.

FIG. 5 is a side view of drive-on watercraft lift 10 in the illustrated loaded or neutral floating position "C" where the top surface of drive-on watercraft lift 10 is parallel to the waterline when a watercraft 51 is on the drive-on watercraft lift.

Figure 6:
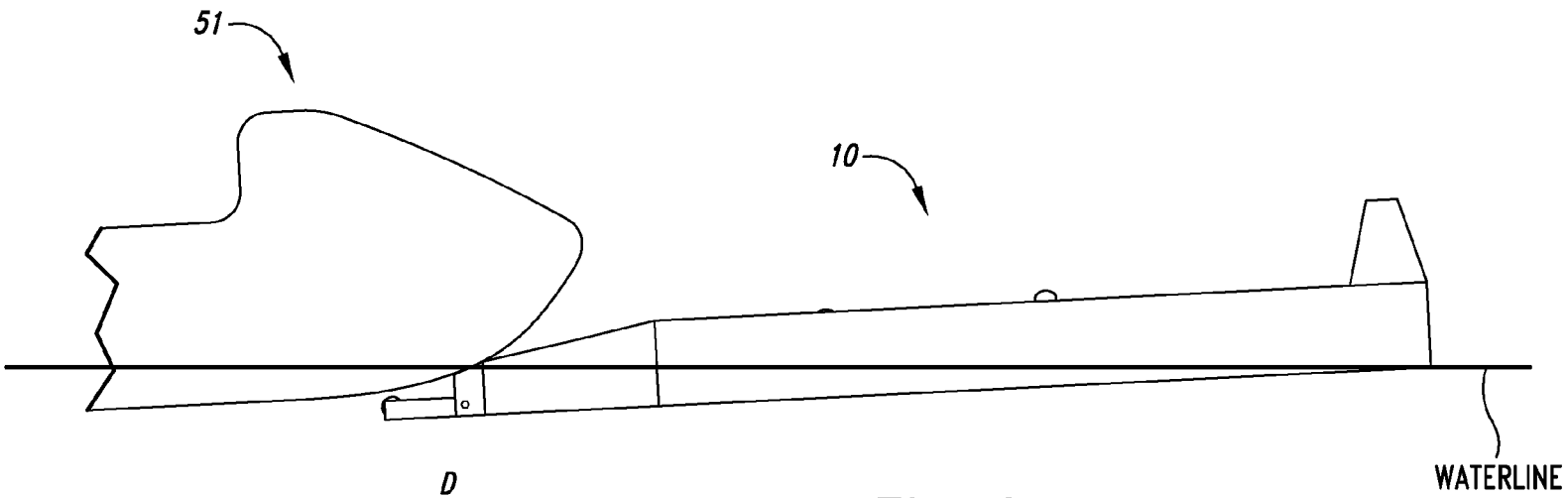
FIG. 6 is a side view of the floating drive-on watercraft lift of FIG. 1 with a watercraft loading.

FIG. 6 is a side view of drive-on watercraft lift 10 in the loading position "D" where the top surface of the drive-on watercraft lift 10 is angled back compared to the waterline. As watercraft 51 contacts aft port extension 21 and aft starboard extension 22 as it passes over and at least partially enters aft opening 23, the aft portion of drive-on watercraft lift 10 is pushed under the waterline due to the volume differential between the front 24 and aft port extension 21 and aft starboard extension 22. As the watercraft 51 further loads onto drive-on watercraft lift 10, the drive-on watercraft lift approaches the illustrated loaded position "C" shown in FIG. 5 in a smooth and safe manner.

Figure 7:
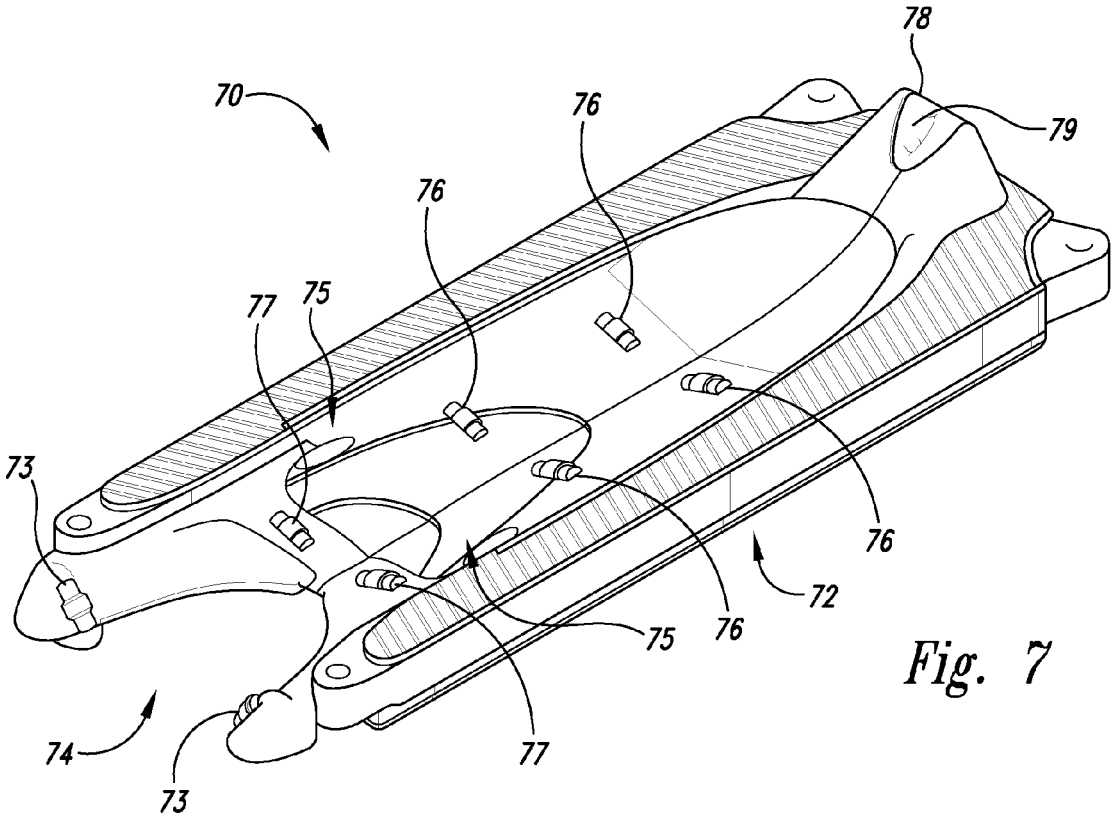
FIG. 7 is a second embodiment of the floating drive-on watercraft lift.

FIG. 7 is an isometric view of a second embodiment drive-on watercraft lift 70 comprising of a rear pivoting entry portion 71 pivotally attached to a one-piece main flotation portion 72 by pivots 75 at a forward end of the pivoting entry portion arrange along a laterally extending, substantially horizontal hinge line. The pivoting entry portion 71 includes starboard and port entry features 73 which engage the hull of the watercraft when loading and unloading and are shown as rollers in FIG. 7 and raised bumps in FIG. 8, a watercraft guide entryway cutout or opening 74, hull rollers 77 located just forward of the watercraft guide entryway opening, and the pivots 75 located forward of the hull rollers 77. The main floatation portion 72 includes two sets of hull rollers 76 and a bow stop 78. The bow stop 78 is configured to contact the watercraft 51 (see FIG. 11) at a location above the waterline for engaging and limiting forward movement of the watercraft loaded onto the drive-on watercraft lift 70. Bow stop 78 has through-hole 79 for running a lanyard to the bow eye of a watercraft (not shown). Bow stop 78 is preferably higher than the draft of the watercraft, and the portion of the bow stop positioned to touch the watercraft is removable and separately replaceable from main floatation portion 72.

The watercraft guide entryway opening 74 is defined at the forward end thereof by a transverse member at which the hull rollers 77 are located, and by starboard and port rearward extensions of the pivoting entry portion 71 extending rearward from the transverse member, with the starboard and port entry features 73 being located toward the rearward end of the starboard and port rearward extensions. The watercraft guide entryway opening 74 is rearwardly opening to provide access by the watercraft 51 between the starboard and port rearward extensions, and the width of the watercraft guide entryway opening between the starboard and port rearward extensions is preferably wider than half the max chine beam of the watercraft 51. As will be described below, the watercraft guide entryway opening 74 of pivoting entry feature 71 centers the watercraft 51 on drive-on watercraft lift 70 for ease of entry, and assists in longitudinal axial alignment of the watercraft with the watercraft lift.

Figure 15:
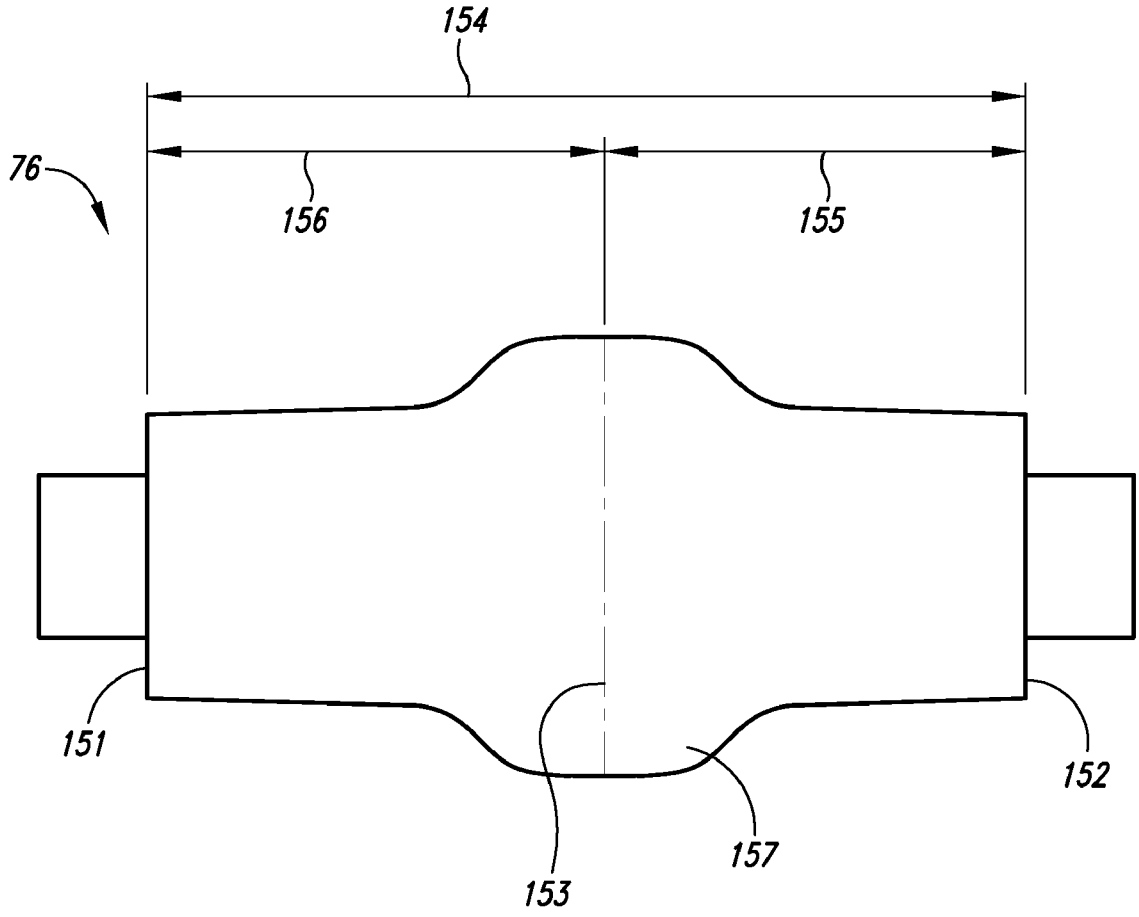
FIG. 15 is an enlarged plan view of a hull roller used with the floating drive-on watercraft lift of FIG. 7.

The rollers used for the starboard and port entry features 73 and the hull rollers 77 of the pivoting entry portion 71, and the hull rollers 76 of the main floatation portion 72, shown in FIG. 7 have the same general construction, and one of the hull rollers 76 which is representative of all these rollers is shown in FIG. 15. The hull roller 76 has a generally cylindrical contact portion 157 and reduced diameter generally cylindrical portions 151 and 152, one to each side of the contact portion 157. Contact portion 157 of the hull roller 76 has a diameter sufficient to contact and support the watercraft 51 and a width of less than 3 inches. The reduced diameter portions 151 and 152 each have a diameter sufficiently less than the diameter of the contact portion to avoid contact with a hull strake of the watercraft when loading and unloading the watercraft. The overall length 154 (shown as 7 inches) of each hull roller 76 is more than twice the width of the roller's contact portion 157. The contact portion 157 of the hull roller 76 is preferably located off the center of the roller, and in the illustrated embodiment of FIG. 15, a transverse center line 153 of the contact portion 157 is located at a distance 156 (shown as 3.65 inches) from the outward end of the reduced diameter portion 151, and at a distance 155 (shown as 3.35 inches) from the outward end of the reduced diameter portion 152.

Figure 8:
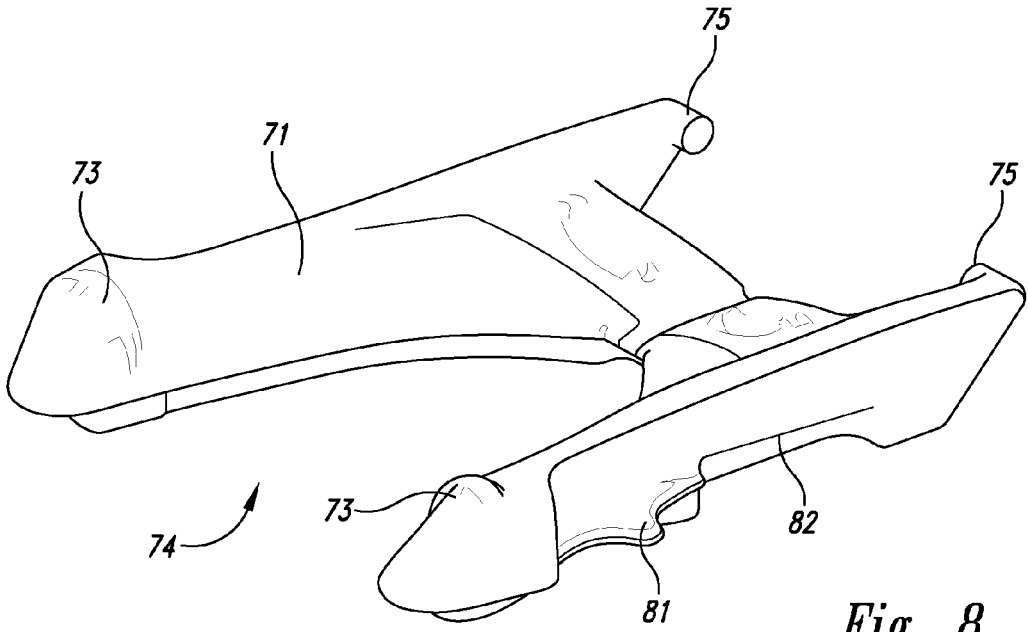
FIG. 8 is an isometric detail view of the pivoting entry portion of the floating drive on watercraft lift of FIG. 7.

FIG. 8 is an enlarged isometric view of pivoting entry portion 71 shown separate from the main flotation portion 72 showing up stop 81 and down stop 82 on the starboard side of the pivoting entry portion. The same up stop 81 and down stop 82 are located on the port side of the pivoting entry portion 71. Entry portion 71 is positively buoyant and is filled with foam or air. As noted above, in FIG. 8 the entry features 73 of pivoting entry portion 71 are shown as raised bumps rather than the rollers shown in FIG. 7.

Figure 9:
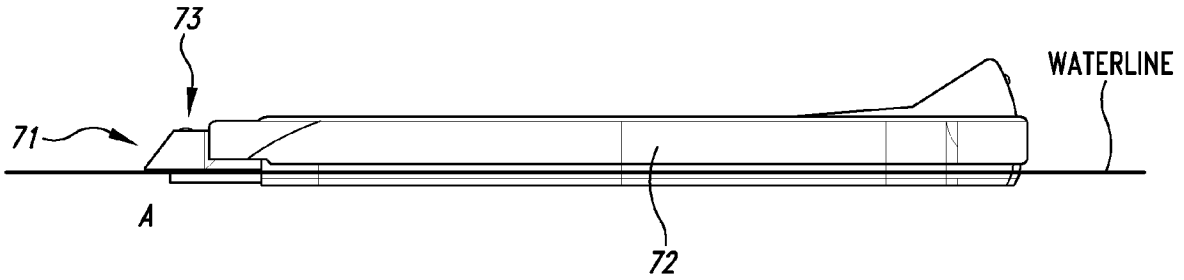
FIG. 9 is a side view of the floating drive-on watercraft lift of FIG. 7 with the pivoting entry portion above the waterline.

FIG. 9 is a side view of unloaded floating watercraft lift 70 with pivoting entry portion 71 in illustrated position "A" with entry features 73 above waterline and free from marine growth. The floatation of pivoting entry portion 71 keeps entry features 73 above the waterline.

Figure 10:
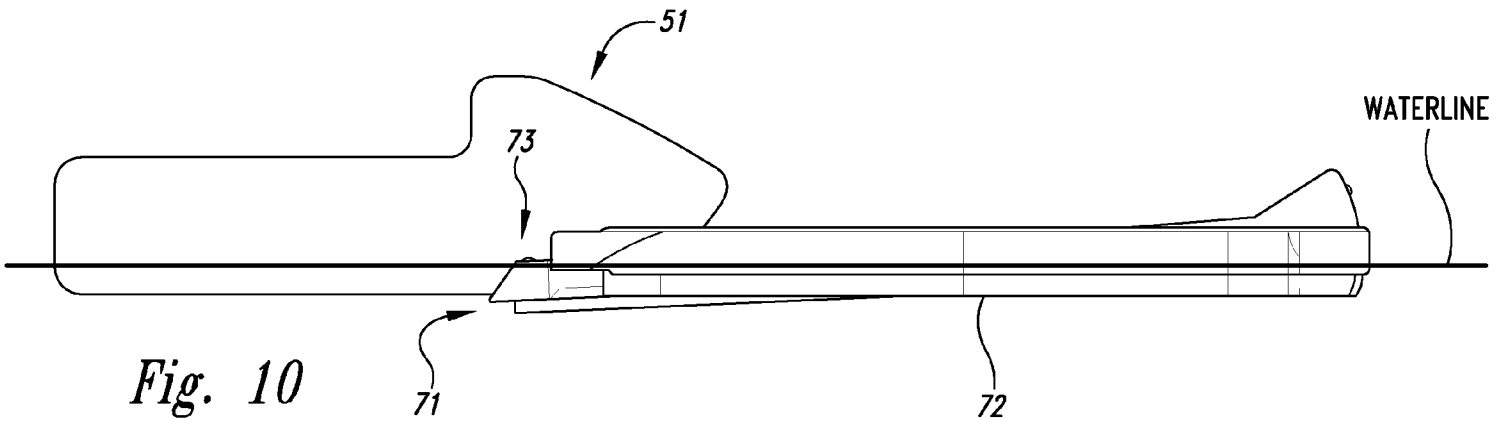
FIG. 10 is a side view of the floating drive-on watercraft lift of FIG. 7 with a watercraft loading.
Figure 12:
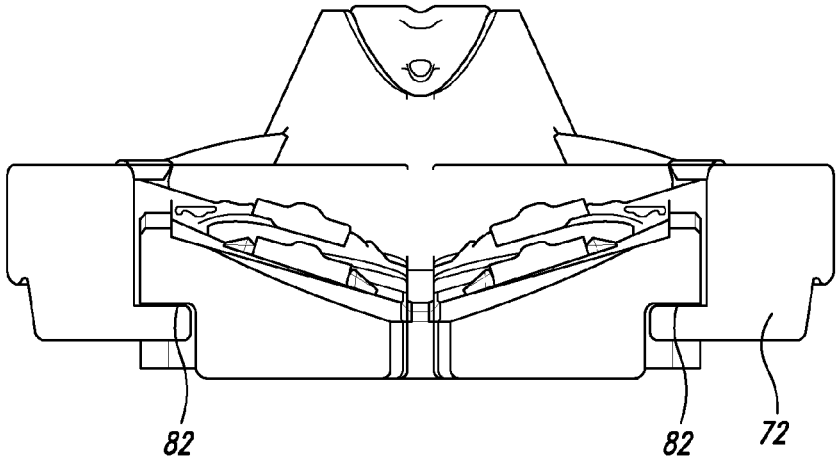
FIG. 12 is a cross-sectional end view of the pivoting entry portion engaging on the main floatation portion of the floating drive-on watercraft lift of FIG. 7.

FIG. 10 is a side view of the floating watercraft lift 70 with a watercraft 51 in the process of loading. When watercraft 51 comes in contact with pivoting entry portion 71, the pivoting entry portion pivots downward causing entry features 73 to drop below the waterline to illustrated position "B" and engage watercraft 51. As best illustrated in FIG. 12, down stop 82 engages main floatation portion 72. The combination of the entry features 73 dropping below the waterline to engage the watercraft 51 and the down stop 82 engaging the main floatation portion 72 creates a low loading angle between the watercraft and the watercraft lift 70 allowing for watercraft loading with minimal propulsion required from the watercraft.

Figure 11:
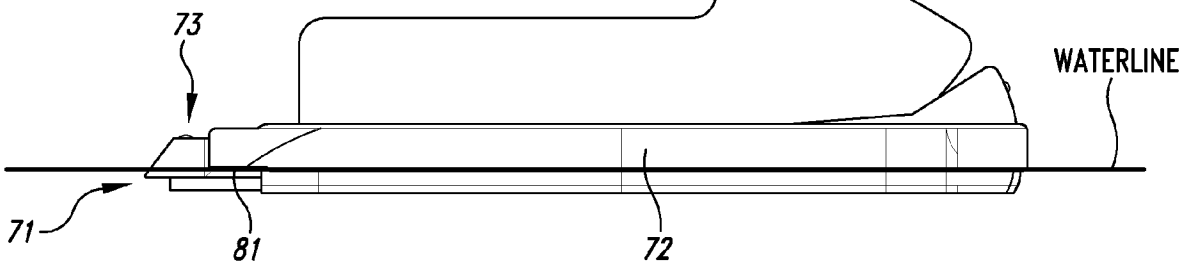
FIG. 11 is side view of the floating drive-on watercraft lift of FIG. 7 loaded with a watercraft in the loaded position.

FIG. 11 is a side view of the floating watercraft lift 70 with watercraft 51 loaded. Pivoting entry portion 71 returns to illustrated position "A" with entry features 73 above the waterline and free from marine growth. The floatation of pivoting entry portion 71 keeps entry features 73 above the waterline. If watercraft 51 is heavy, up stop 81 of pivoting entry feature 71 may engage main floatation portion 72, thereby effectively providing more buoyancy to the stern of watercraft lift 70.

FIG. 12 is a cross-sectional end view of watercraft lift 70 showing down stop 82 of pivoting entry portion 71 engaging on main floatation portion 72.

Figure 13:
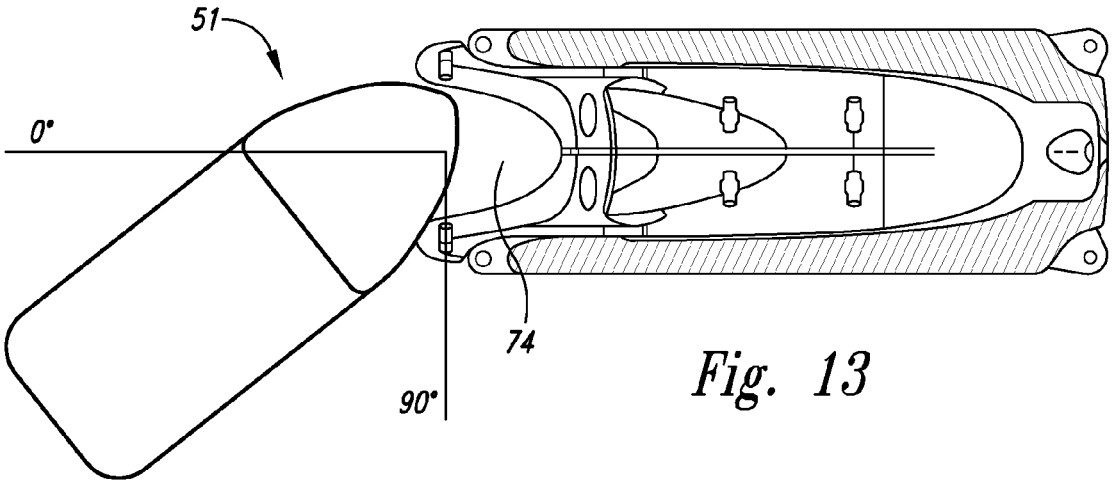
FIG. 13 is a top plan view of a watercraft loading the floating drive-on watercraft lift of FIG. 7 at an angle.

FIG. 13 is a top plan view showing watercraft 51 loading drive on watercraft lift 70 at a loading direction between 0° and 90°. Watercraft guide entryway opening 74 of pivoting entry feature 71 centers the watercraft 51 on drive-on watercraft lift 70 for ease of entry. By the watercraft guide entryway opening 74 assisting in longitudinal axial alignment of the watercraft 51 with the drive-on watercraft lift 70, the loading direction of 0° shown in FIG. 14 can more easily be achieved.

Figure 14:
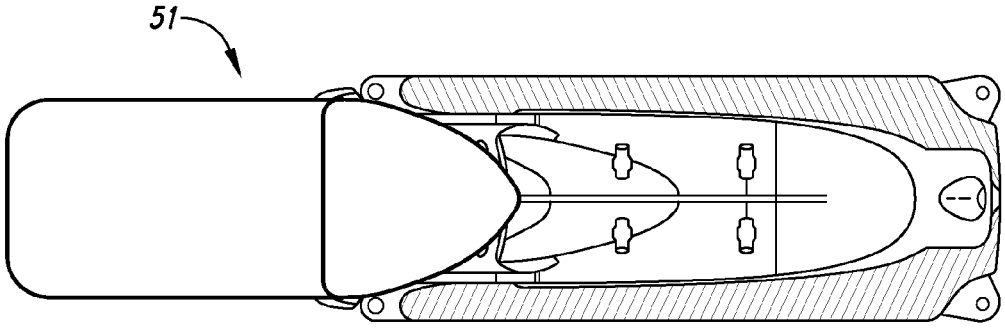
FIG. 14 is a top plan view of a watercraft loading the floating drive-on watercraft lift of FIG. 7.

FIG. 14 is a top plan view showing watercraft 51 aligned at a loading direction of 0° with drive-on watercraft lift 70.

In a preferred embodiment, the drive-on watercraft lift has the pivoting entry portion pivotally attached to the main flotation portion along a substantially horizontal hinge line. Further, the drive-on watercraft lift contains at least two sets of roller. Preferably, the rollers are sufficiently wide to distribute load to the main floatation portion, but have a narrow contact portion to avoid the strakes of the watercraft. The narrow contact portion of the roller is preferably off-center.

What is claimed is:

1. A floating drive-on docking system for a watercraft having a hull, comprising:

at least one main floatation portion comprised of at least one buoyant pontoon; and at least one entry portion wherein the entry portion is pivotally attached to the main floatation portion, the pivoting entry portion having at least one entry feature configured to be engaged by the watercraft hull upon initiation of loading of the watercraft onto the floating drive-on docking system prior to the watercraft engaging the main floatation portion, the pivoting entry portion being configured to automatically self position itself with the at least one entry feature held above the waterline when not engaged by the watercraft hull, and when engaged by the watercraft hull upon initiation of loading of the watercraft onto the floating drive-on docking system to automatically pivot downward and move the at least one entry feature to a position below the waterline in response to the force applied to the at least one feature by the watercraft hull without application of additional force being applied to the pivoting entry portion and with the pivoting entry portion being moved to a position with an upward incline relative to the main floatation portion which facilitates receiving the watercraft hull on the pivoting entry portion and subsequent forward movement of the watercraft hull onto the main floatation portion.

2. The floating drive-on docking system of claim 1 wherein the pivoting entry portion has a counterbalance weight portion which applies a rotational force to the pivoting entry portion to automatically self position itself the pivoting entry portion to a position with the at least one entry feature held above the waterline when not engaged by the watercraft hull.

3. The floating drive-on docking system of claim 1 wherein the at least one entry feature is a roller.

4. The floating drive-on docking system of claim 1 wherein the at least one entry feature is a raised bump.

5. The floating drive-on docking system of claim 1 wherein the pivoting entry portion is buoyant.

6. The floating drive-on docking system of claim 2 wherein the pivoting entry portion has a downward stopping member limiting the downward pivotal movement of the at least one entry portion.

7. The floating drive-on docking system of claim 6 wherein the pivoting entry portion has an upward stopping member limiting the upward pivotal movement of the at least one entry portion.

8. The floating drive-on docking system of claim 1 wherein the pivoting entry portion has a watercraft guide wider than half the max chine beam of the watercraft.

9. The floating drive-on docking system of claim 1 wherein the pivoting entry portion is buoyant, and the main floatation portion has a first stopping member and the pivoting entry portion has a second stopping member, the first stopping member being positioned to be engaged by the second stopping member upon pivotal movement of the pivoting entry portion downward beyond a first limit of downward pivotal movement thereof under a downward force applied to the at least one entry feature when engaged by the watercraft hull to limit an amount of upward incline of the pivoting entry portion relative to the main floatation portion under the weight of the watercraft being applied to the at least one entry feature.

10. The floating drive-on docking system of claim 9 wherein the main floatation portion has a third stopping member and the pivoting entry portion has a fourth stopping member, the third stopping member being positioned to be engaged by the fourth stopping member upon pivotal movement of the pivoting entry portion upward beyond a first limit of upward pivotal movement thereof under a downward force applied to the main floatation portion when supporting the watercraft thereon to limit an amount of upward pivotal movement of the pivoting entry portion relative to the main floatation portion under the weight of the watercraft being applied thereto and transfer an upward buoyancy force of the pivoting entry portion to the main floatation portion through the fourth stopping member engaging the third stopping member when the watercraft is being supported by the main floatation portion.

11. The floating drive-on docking system of claim 1 wherein the at least one entry portion has a watercraft guide wider than half the max chine beam of the watercraft.

12. The floating drive-on docking system of claim 1 wherein the pivoting entry portion is buoyant, and the main floatation portion has a first stopping member and the pivoting entry portion has a second stopping member, the first stopping member being positioned to be engaged by the second stopping member upon pivotal movement of the pivoting entry portion upward beyond a first limit of upward pivotal movement thereof under a downward force applied to the main floatation portion when supporting the watercraft thereon to limit an amount of upward pivotal movement of the pivoting entry portion relative to the main floatation portion under the weight of the watercraft being applied thereto and transfer an upward buoyancy force of the pivoting entry portion to the main floatation portion through the second stopping member engaging the first stopping member when the watercraft is being supported by the main floatation portion.

13. The floating drive-on docking system of claim 1 wherein the main floatation portion contains rollers.

14. The floating drive-on docking system of claim 13 wherein the main floatation portion contains a plurality of roller sets, each positioned symmetrically around a longitudinal centerline of the main floatation portion.

15. The floating drive-on docking system for a watercraft of claim 14 wherein the rollers each have a contact portion with a larger diameter section less than half the width of the roller, and a reduced diameter portion with a diameter sufficiently less than the diameter of the contact portion to avoid contact with strakes of the watercraft.

16. The floating drive-on docking system of claim 15 wherein the contact portion of the roller is off-center.

17. The floating drive-on docking system of claim 1 wherein the main floating portion has a bow stop higher than the draft of the watercraft with a portion of the bow stop positioned to touch the watercraft.

18. The floating drive-on docking system of claim 17 wherein the bow stop has a thru hole for passage of a lanyard therethrough for attachment to a bow eye of the watercraft.

19. The floating drive-on docking system of claim 17 wherein the bow stop is removably attached to the main floatation portion, whereby the bow stop is replaceable.

20. A floating drive-on docking system for a watercraft having a hull, comprising:

a main floatation portion comprised of at least one buoyant pontoon, the main floatation portion being sufficiently buoyant to receive and support the watercraft thereon, and having an aft port rearward extension and an aft starboard rearward extension defining an aft opening therebetween; and an entry portion positioned in the aft opening, the entry portion having a transverse portion with an upper surface portion, port and starboard forward end portions forward of the transverse portion and pivotally attached to the main floatation portion at port and starboard pivots, respectively, and port and starboard rearward extensions extending rearward from the transverse portion and defining a watercraft guide entryway therebetween having a width sized to receive the watercraft hull, the entry portion further having at least one entry feature located on the transverse portion at the upper surface portion and extending above the upper surface portion and configured to be engaged by the watercraft hull upon initiation of loading of the watercraft onto the floating drive-on docking system prior to the watercraft engaging the main floatation portion and to hold the watercraft hull above the upper surface portion, the entry portion having sufficient buoyancy to pivot the transverse portion upward about the pivot points and position the at least one entry feature above the waterline when not engaged by the watercraft hull but in position for engagement with the watercraft hull when the watercraft enters the watercraft guide entryway between the port and starboard rearward extensions to automatically upon contact by the watercraft hull pivot the transverse portion downward about the pivot points and position the at least one entry feature below the waterline without application of additional force being applied to the entry portion and position the entry portion to facilitate receiving the watercraft hull thereon and subsequent forward movement of the watercraft hull onto the main floatation portion.

21. The floating drive-on docking system of claim 20, wherein a rearward end portion of each of the port and starboard rearward extensions has at least one entry feature positioned to engage the watercraft hull upon entry of the watercraft hull within the watercraft guide entryway between the port and starboard rearward extensions and facilitate longitudinal alignment of the watercraft hull with the entry portion.

22. The floating drive-on docking system of claim 20 wherein the at least one entry feature is a roller.

23. The floating drive-on docking system of claim 20 wherein the main floatation portion has a first stopping member and the entry portion has a second stopping member, the first stopping member being positioned to be engaged by the second stopping member upon pivotal movement of the transverse portion downward about the pivot points beyond a first limit of downward pivotal movement thereof under a downward force applied to the at least one entry feature when engaged by the watercraft hull to limit an amount of upward incline of the entry portion relative to the main floatation portion under the weight of the watercraft being applied to the at least one entry feature.

24. The floating drive-on docking system of claim 23 wherein the main floatation portion has a third stopping member and the entry portion has a fourth stopping member, the third stopping member being positioned to be engaged by the fourth stopping member upon pivotal movement of the transverse portion upward about the pivot points beyond a first limit of upward pivotal movement thereof under a downward force applied to the main floatation portion when supporting the watercraft thereon to limit an amount of upward pivotal movement of the entry portion relative to the main floatation portion under the weight of the watercraft being applied thereto and transfer an upward buoyancy force of the entry portion to the main floatation portion through the fourth stopping member engaging the third stopping member when the watercraft is being supported by the main floatation portion.

25. The floating drive-on docking system of claim 20 wherein the main floatation portion has a first stopping member and the entry portion has a second stopping member, the first stopping member being positioned to be engaged by the second stopping member upon pivotal movement of the transverse portion upward about the pivot points beyond a first limit of upward pivotal movement thereof under a downward force applied to the main floatation portion when supporting the watercraft thereon to limit an amount of upward pivotal movement of the entry portion relative to the main floatation portion under the weight of the watercraft being applied thereto and transfer an upward buoyancy force of the entry portion to the main floatation portion through the second stopping member engaging the first stopping member when the watercraft is being supported by the main floatation portion.

26. The floating drive-on docking system of claim 20 wherein the at least one main floatation portion has a bow stop higher than the draft of the watercraft with a portion of the bow stop positioned to touch the watercraft.

27. The floating drive-on docking system of claim 26 wherein the bow stop is removably attached to the main floatation portion, whereby the bow stop is replaceable.

28. The floating drive-on docking system of claim 20 wherein the bow stop has a thru hole for passage of a lanyard therethrough for attachment to a bow eye of the watercraft.

29. The floating drive-on docking system of claim 20 wherein the at least one main floatation portion has a bow stop extending upward higher than the draft of the watercraft with a contact portion positioned to contact the watercraft at a location above the waterline.

30. A floating drive-on docking system for a watercraft having a hull, comprising:

a main floatation portion comprised of at least one buoyant pontoon, the main floatation portion being sufficiently buoyant to receive and support the watercraft thereon, and having an aft port rearward extension and an aft starboard rearward extension defining an aft opening therebetween; and an entry portion positioned in the aft opening, the entry portion having a transverse portion, port and starboard forward end portions forward of the transverse portion and pivotally attached to the main floatation portion, and port and starboard rearward extensions extending rearward from the transverse portion and defining a watercraft guide entryway therebetween having a width sized to receive the watercraft hull, the entry portion further having at least one entry feature located at the transverse portion and configured to be engaged by the watercraft hull upon initiation of loading of the watercraft onto the floating drive-on docking system prior to the watercraft engaging the main floatation portion and to support the watercraft hull, the entry portion having sufficient buoyancy to pivot the transverse portion upward and position the at least one entry feature above the waterline when not engaged by the watercraft hull but in position for engagement with the watercraft hull when the watercraft enters the watercraft guide entryway between the port and starboard rearward extensions to automatically upon contact by the watercraft hull pivot the transverse portion downward and position the at least one entry feature below the waterline without application of additional force being applied to the entry portion and position the entry portion to facilitate receiving the watercraft hull thereon and subsequent forward movement of the watercraft hull onto the main floatation portion.

31. The floating drive-on docking system of claim 30 wherein the main floatation portion has a bow stop extending upward higher than the draft of the watercraft with a contact portion positioned to contact the watercraft at a location above the waterline.

* * * * *